United States Patent [19]

Arai et al.

[11] 4,107,646

[45] Aug. 15, 1978

[54] CENTRALIZED WARNING SYSTEM FOR VEHICLE

[75] Inventors: Hiroshi Arai, Toyota; Koichi Taniguchi, Kariya, both of Japan

[73] Assignees: Nippondenso Co., Ltd.; Toyota Jidosha Kogyo Kabushiki Kaisha, Toyota, both of Japan

[21] Appl. No.: 781,865

[22] Filed: Mar. 28, 1977

Related U.S. Application Data

[63] Continuation of Ser. No. 489,723, Jul. 18, 1974, abandoned.

[30] Foreign Application Priority Data

Feb. 28, 1973 [JP] Japan ..... 48-85083

[51] Int. Cl.[2] ..... G08B 19/00; G08B 29/00

[52] U.S. Cl. ..... 340/52 F; 307/10 R; 340/517

[58] Field of Search ..... 340/52 R, 52 F, 412, 340/414, 415, 413, 27 R; 307/10 R; 180/103 R

[56] References Cited

U.S. PATENT DOCUMENTS

| | | | |
|---|---|---|---|
| 2,892,181 | 6/1959 | Benson et al. | 340/52 F |
| 3,084,338 | 4/1963 | Mauer et al. | 340/412 |
| 3,550,121 | 12/1970 | Porter, Jr. | 340/415 |
| 3,566,401 | 2/1971 | Smith et al. | 340/52 F |
| 3,582,925 | 6/1971 | Porter, Jr. | 340/213.1 |
| 3,597,729 | 8/1971 | Lopez | 340/52 F |
| 3,681,658 | 8/1972 | Naoi et al. | 317/13 R |
| 3,711,827 | 1/1973 | Houseman | 340/52 F |
| 3,714,646 | 1/1973 | Nurnberg et al. | 340/412 |
| 3,810,086 | 5/1974 | Bensel et al. | 340/52 F |
| 3,835,450 | 9/1974 | Reck | 340/52 F |
| 3,893,108 | 7/1975 | McBride, Jr. | 340/420 |

*Primary Examiner*—John W. Caldwell
*Assistant Examiner*—Joseph E. Nowicki
*Attorney, Agent, or Firm*—Cushman, Darby & Cushman

[57] ABSTRACT

A centralized warning system for a vehicle comprising a fault detecting sensor mounted at each of a plurality of check points of the vehicle, an indicator operating circuit responsive to each of the sensors to indicate the presence of a fault at the check point, a logical circuit responsive to at least one indication signal from the indicator operating circuits for generating a logical output, a pulse generating circuit responsive to the logical output, a timer circuit for actuating the pulse generating circuit for a predetermined period of time, a master warning device adapted to be operated by the pulse generating circuit, forced operation means for forcibly operating the indicator operating circuits and the master warning device and checking them for faults therein, and means for terminating the forced operation of the indicator operating circuits and the master warning device during the time between the actuation of the pulse generating circuit and the moment at which the normal centralized warning function is to be activated.

31 Claims, 10 Drawing Figures

CENTRALIZED WARNING SYSTEM FOR VEHICLE

This is a continuation, of application Ser. No. 489,723 filed July 18, 1974, abandoned.

The present invention relates to a centralized warning system for vehicles whereby any malfunctions of various component parts and devices of a vehicle, e.g., an automobile, which are essential in the safe driving of the automobile, are centrally monitored and warning is given against them at one place.

In known vehicle centralized warning systems of the above type, when at least one of a plurality of sensors for detecting faults at various check points of a vehicle generates a signal indicating a fault, a centralized warning lamp is activated to flash. A disadvantage of this type of centralized warning systems is that while the flashing of the lamp can warn the driver of the presence of a fault in at least one of the check points, it is impossible for the driver to know exactly in which component part or device the fault was detected, thus making it impossible to take immediately any effective measure against the fault such as the replacement of the defective part or the like.

With a view to overcoming the foregoing difficulty, it is an object of the present invention to provide a centralized warning system for a vehicle comprising a sensor provided at each of a plurality of the essential check points of the vehicle to always monitor the condition of the check point, and a plurality of indicator operating circuits and a plurality of indicators operatively associated with the plurality of sensors to indicate faults, wherein when at least one of the indicator operating circuits generates an indication signal, pulse signals are generated to cause a master warning device to go on and off intermittently to give centralized warning against the fault, whereby when a fault occurs in at least one of the check points, the driver can immediately know through the centralized warning the occurrence of the fault, and moreover the driver can immediately know the location of the fault through the indication of the indicator, thus allowing the driver to take any effective measure such as the replacement of the defective part to prevent the occurrence of an accident due to the fault detected at the check point.

It is another object of the present invention to provide a centralized warning system of the above type further comprising a timer circuit for limiting the generation of the pulse signals from the pulse generating circuit to within a predetermined time period.

It is still another object of the present invention to provide a centralized warning system of the above type further comprising means for forcibly activating the indicating and warning function and causing the indicators to go on in response to the closing of a power circuit, and means for terminating the forced lighting of the indicators before the time at which the normal centralized warning function is to be activated.

The centralized warning system according to one form of the invention has a great advantage that by virtue of a plurality of sensors arranged to detect the conditions of various check points of a vehicle in the form of electric signals, it is possible to always monitor the conditions of all the check points which are essential in the safe driving of the vehicle, that owing to the provision of a plurality of indicator operating circuits and a plurality of indicators arranged to indicate the faulty conditions at the check points in association with the plurality of sensors so that in response to the generation of an output signal from at least one of the indicator operating circuits a pulse generating circuit generates pulse signals to cause a master warning device to go on and off intermittently to give centralized warning, the occurrence of a fault in at least one of the check points can be immediately indicated to the driver by means of the centralized warning consisting of on-off signals which are specially designed to attract the attention of the driver and at the same time the associated indicator separately indicates the check point where the fault is located, thereby allowing the driver to take any immediate measurer such as the replacement of the defective part and thus greatly contributing to the safe driving of the vehicle.

According to another form of the invention, the centralized warning system further comprises a timer circuit that limits the generation of pulse signals from the pulse generating circuit to within a predetermined time period, and this has a great advantage that the generation of centralized warning is not allowed to continue indefinitely, but it is limited by the timer circuit whereby to prevent the driver from being annoyed by the continued warning.

According to still another form of the invention, the centralized warning system further comprises forced operation means for forcibly activating the indicating and warning functions in response to the closing of a power circuit, and stopping means fr terminating the forced operation caused by the forced operation means before the time instant at which the centralized warning function is to be normally activated. This has a great advantage that any faulty condition of the indicating and warning function can be automatically indicated each time the vehicle is started and moreover the reliability of the indicating and warning function can be greatly improved.

Above and other objects, features and advantages of the present invention will become readily apparent from considering the following detailed description in conjunction with the accompanying drawings, in which.

Figure 1:
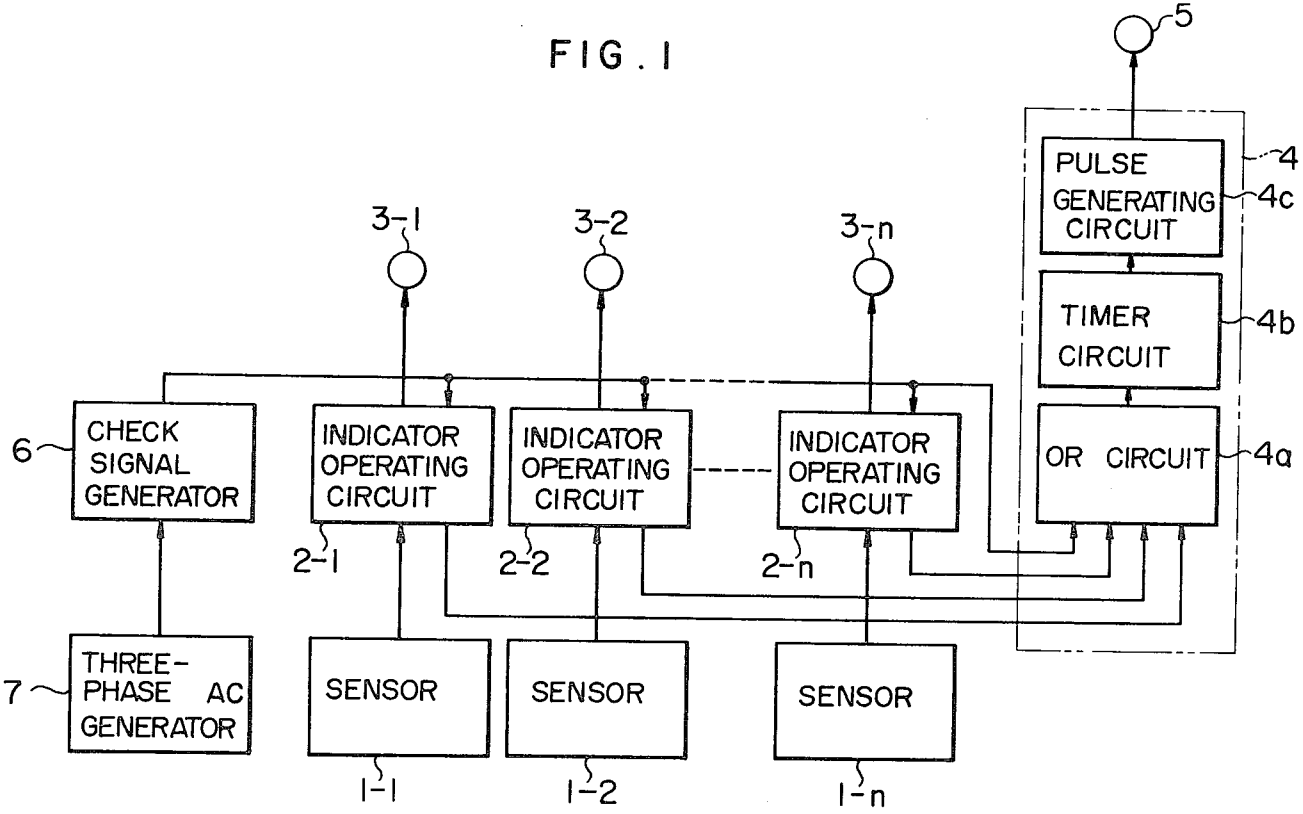
FIG. 1 is a block diagram showing a general construction of an embodiment of a centralized warning system for vehicles according to the present invention.
Figure 3A:
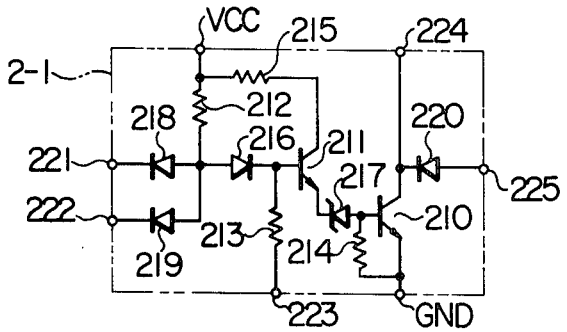
Figure 3B:
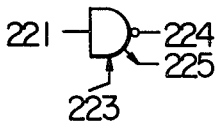
Figure 3C:
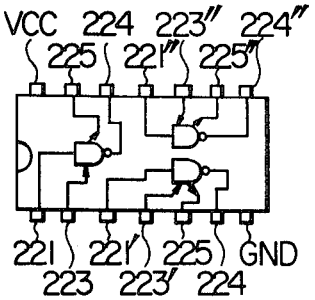
Figure 4:
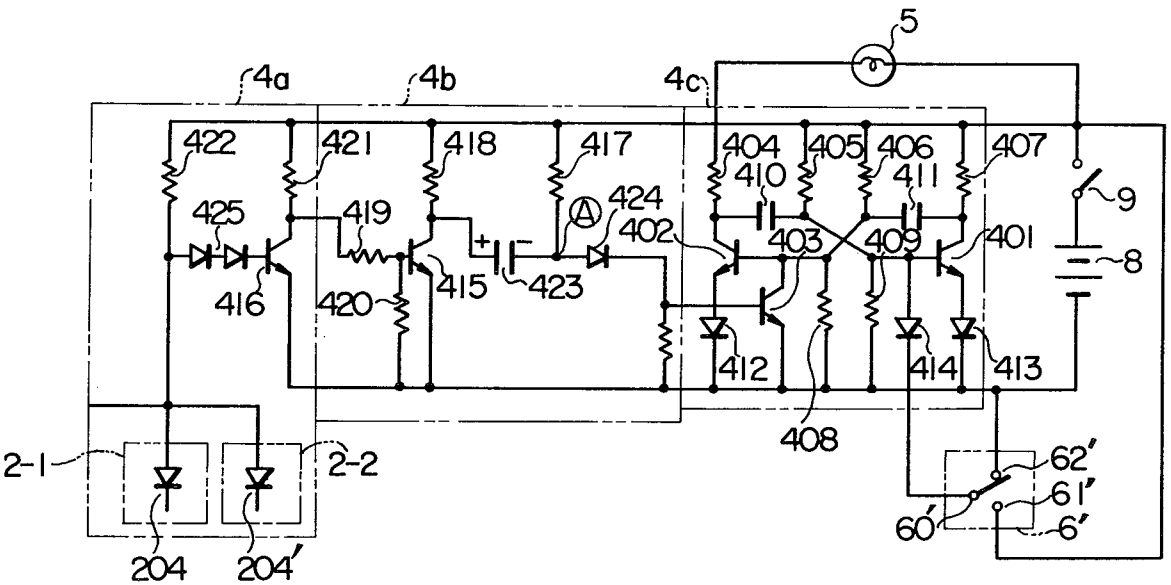
Figure 5:
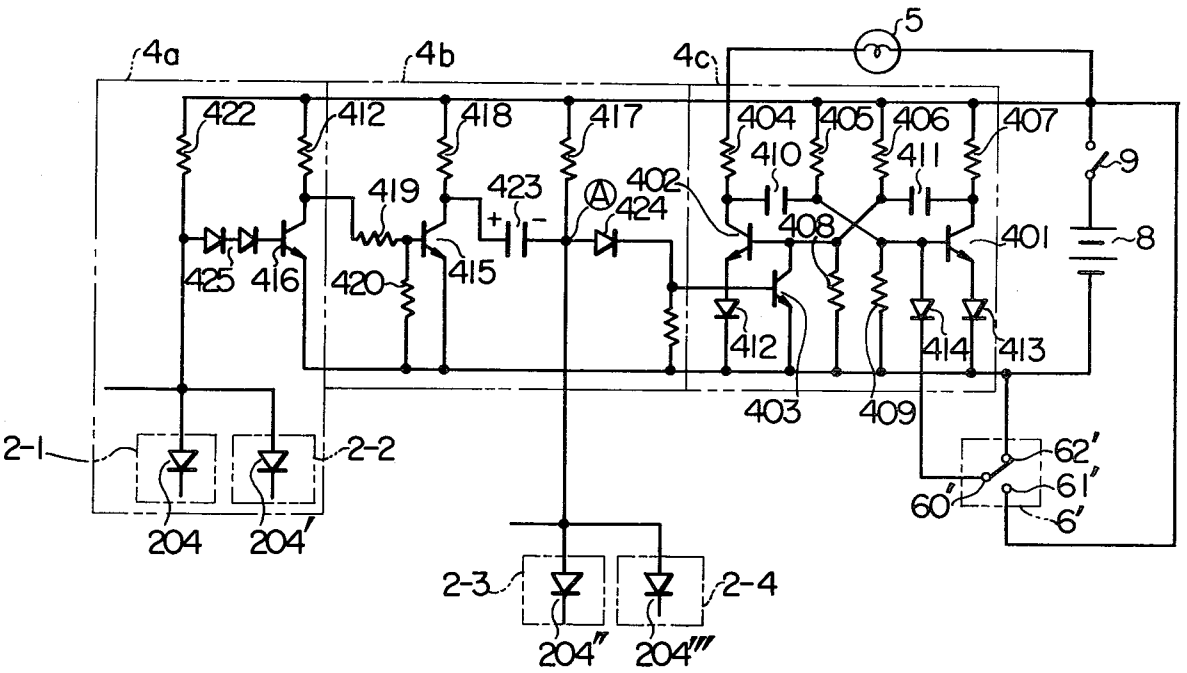
Figure 6:
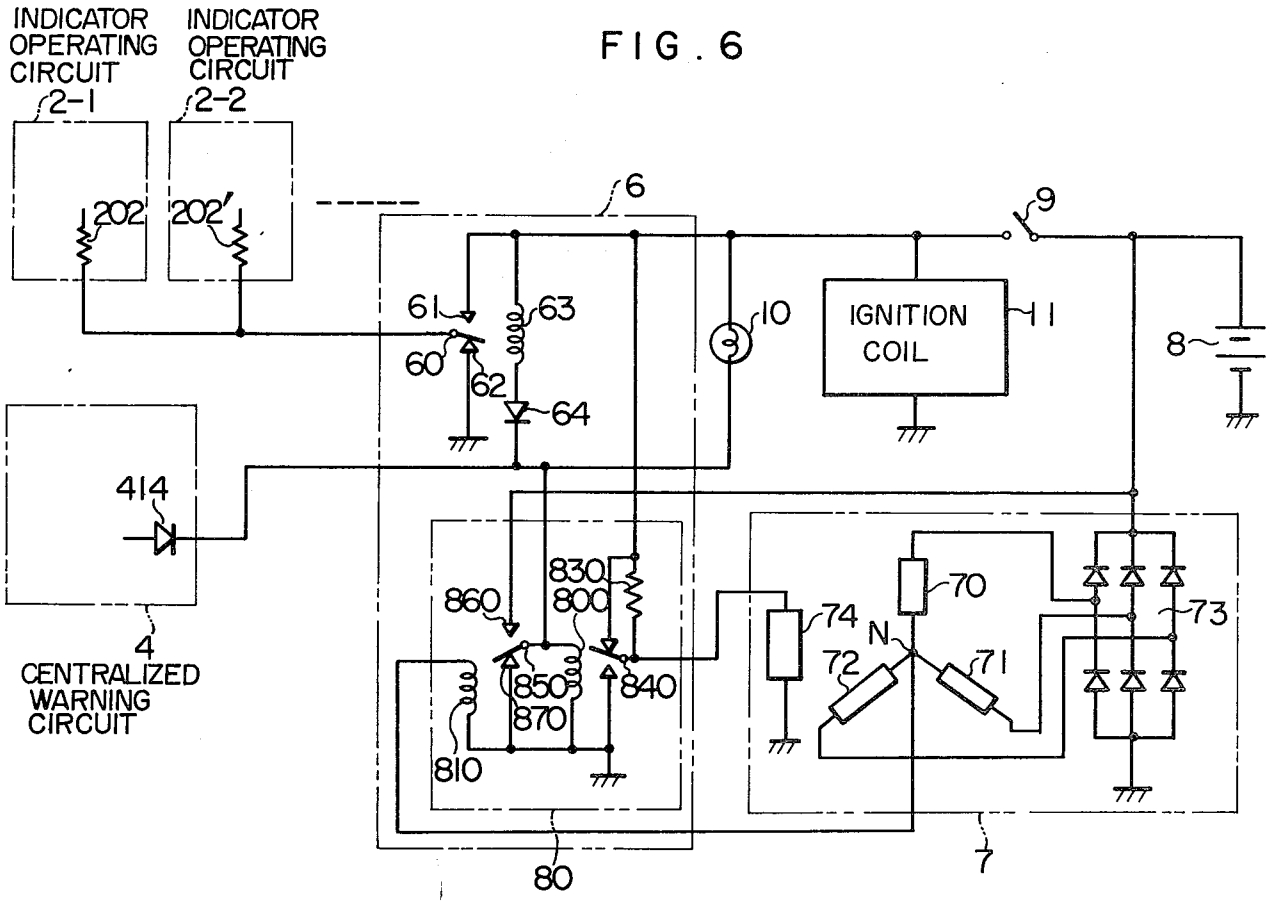
Figure 7:
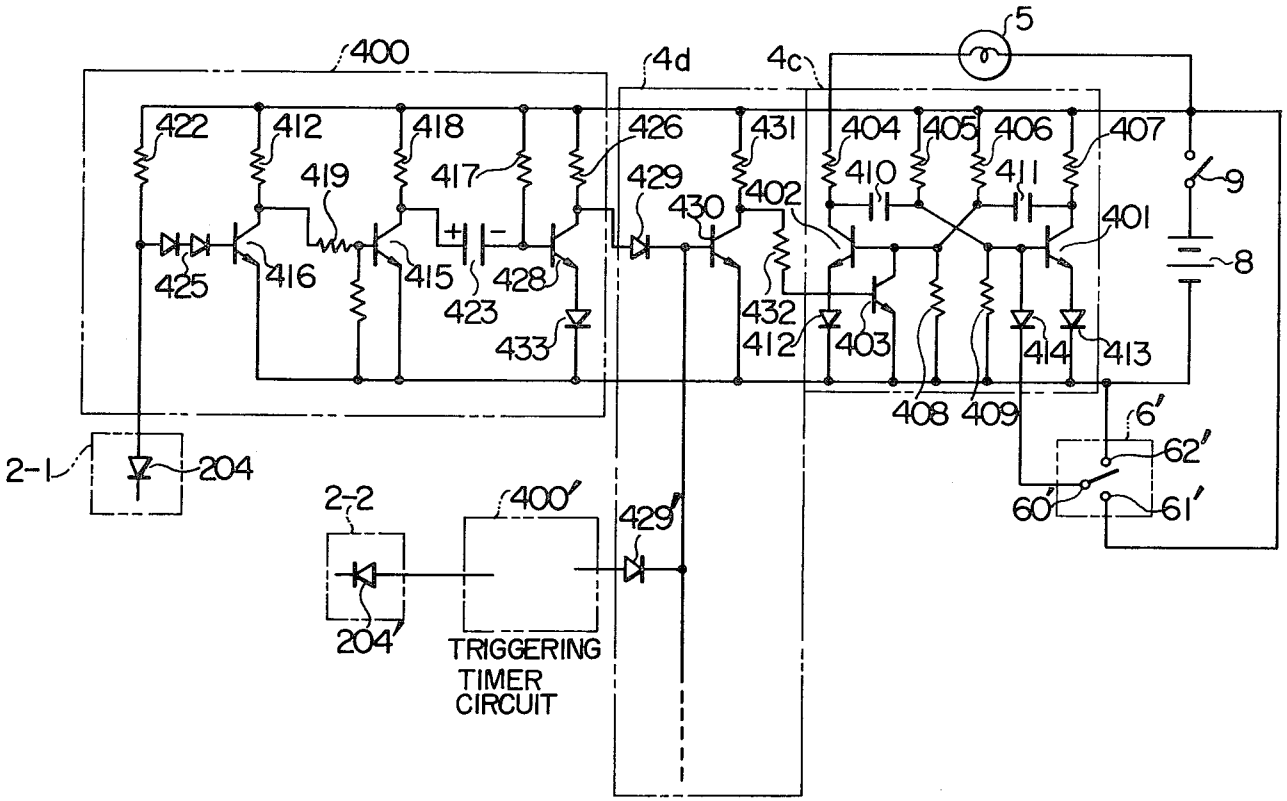

FIGS. 3*a*, 3*b* and 3*c* are wiring diagrams showing an exemplary form of the indicator operating circuit used in the embodiment of FIG. 1;

FIGS. 4 and 5 are wiring diagrams showing exemplary forms of the centralized warning section used in the embodiment of FIG. 1;

FIG. 6 is a wiring diagram showing an exemplary form of the checking section used in the embodiment of FIG. 1; and FIG. 7 is a wiring diagram showing another form of the centralized warning section used in the embodiment of FIG. 1.

Figure 8:
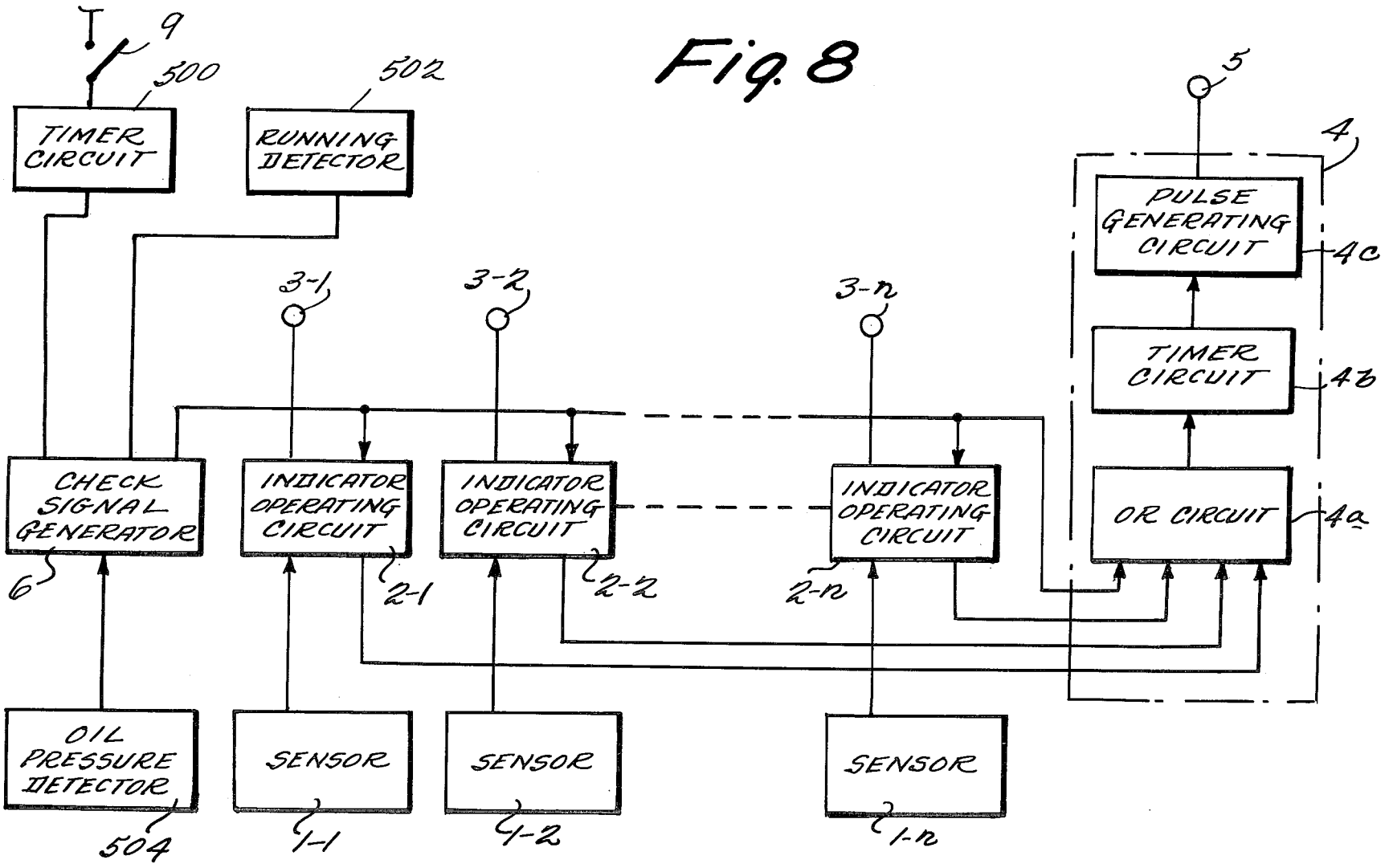

FIG. 8 is a modified embodiment of the present invention.

The present invention will now be described in greater detail with reference to the illustrated embodiment.

Referring first to FIG. 1, the general construction and operation of the entire centralized warning system according to an embodiment of the invention will be described. In FIG. 1, numerals 1-1, 1-2, . . . , 1-n designate sensors which are mounted at the essential check points of a vehicle to detect the conditions thereat in the form of electric signals, that is, whether the component part or device at each check points is functioning normally is detected in the form of electric signal which is either of two distinct kinds of values, i.e., a high potential level and a low potential level. A typical one of these sensors is a flow sensor for detecting whether the quantity of engine lubricating oil is at a proper level. Numerals 2-1, 2-2, . . . , 2-n designate indicator operating circuits for respectively receiving the output signals of the sensors 1-1, 1-2, . . . , 1-n as inputs thereto and generating indication signals to actuate indicators 3-1, 3-2, . . . , 3-n. Each of the indicator operating circuits provides an operation checking function and a second actuation signal generating function for purposes that will be described later. While, at present, it is usual that each of the indicators 3-1, 3-2, . . . , 3-n may for example be a lamp or light emitting diode, it may also be any other light generating element such as liquid crystal. Numeral 4 designates a centralized warning circuit which actuates a master warning device 5 and which serves the double function of producing the logical sum of second actuation signals from the plurality of indicator operating circuits 2-1, 2-2, . . . , 2-n to generate a centralized warning signal for actuating the master warning device and of preventing the generation of the centralized warning signal by a third actuation signal in preference to the second actuation signals. Numeral 4*a* designates an OR circuit for performing the OR operation on the indication signals from the indicator operating circuits 2-1, 2-2, . . . , 2-n, 4*b* a timer circuit for receiving the output of the OR circuit 4*a* to generate a timing output, 4*c* a pulse generating circuit for generating pulse signals or centralized warning signals during a time interval determined by the timer circuit 4*b*. The timer circuit 4*b* is not essential and it may be eliminated, in which case the pulse generating circuit 4*c* continuously generates pulse signals while the ouput of the OR circuit 4*a* is on. Further, the master warning device 5 is identical in construction with the plurality of indicators 3-1, 3-2, . . . , 3-n, and therefore when it is impossible to mount the indicators 3-1, 3-2, . . . , 3-n at positions readily noticeable by the driver due to the limited space in the driver's compartment of the vehicle, the master warning device 5 alone may be mounted in place of the indicators 3-1, 3-2, . . . , 3-n at a position where it is easily seen by the driver. Numeral 6 designates a check signal generator constituting forced operation means for generating a check signal and forcibly operating the indicator operating circuits 2-1, 2-2, . . . , 2-n, the indicators 3-1, 3-2, . . . , 3-n, the centralized warning circuit 4 and the master warning device 5 to check them for faults. Numeral 7 designates a vehicle three-phase AC generator constituting stopping means whereby when the engine has started and attained its idling speed, it is considered that the time has come for activating the normal centralized warning function and the generation of the check signal from the check signal generator is terminated.

Figure 2:
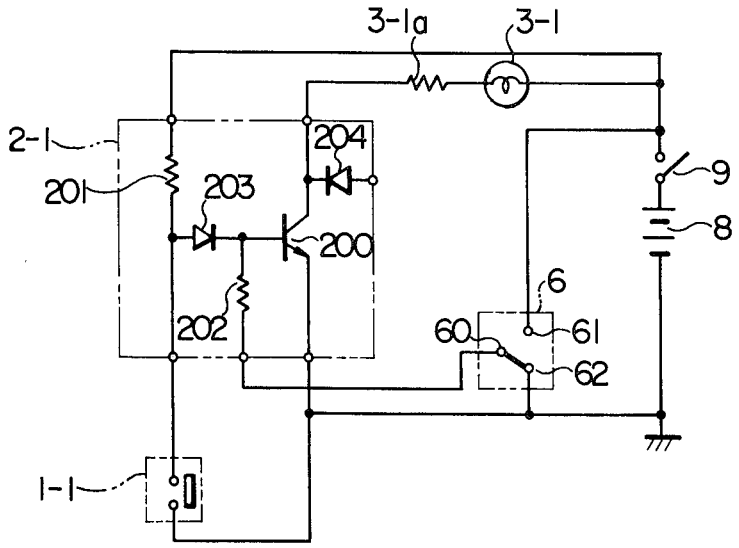
FIG. 2 is a wiring diagram showing an exemplary form of the fault indicating section used in the embodiment of FIG. 1.

Referring now to FIG. 2 illustrating a wiring diagram showing an exemplary form of the fault indicating section including the indicator operating circuit 2-1, the construction and operation of this section will be described. In FIG. 2, numeral 1-1 designates the previously mentioned sensor which detects the presence of a fault condition in the form of an electric signal which is either of two distinct kinds of values. Here, for purposes of simplicity the sensor 1-1 is represented by switch contacts which are normally closed and which are opened under abnormal conditions. Numeral 200 designates a NPN transistor having its base connected to bias resistors 201 and 202, its collector connected to a supply line through the indicator or lamp 3-1 and a protective resistor 3-1*a* and its emitter connected to a ground conductor. Numeral 8 designates a battery constituting a vehicle power source, 9 a key switch for closing a power circuit, 6 the check signal generator which is represented by switch contacts for making one connection to either of two circuits, with a first contact 61 connected to the supply line, a second contact 62 connected to the ground conductor and a movable contact 60 connected to the bias resistor 202 of the transistor 200. As will be described later, the transfer contacts of the check signal generator 6 are operated in such a manner that the movable contact 60 remains in contact with the contact 61 at the supply potential until the engine is started, and it comes into and remains in contact with the contact 62 at the ground potential after the started engine has reached the idling speed. Numeral 203 designates a level shifting diode for positively applying the output signal of the sensor 1-1 to the transistor 200, 204 a diode for applying the second actuation signal to the centralized warning circuit 4 that will be described later, whereby when it is associated with the second and third indicator operating circuits, the logical sum of the second actuation signal with their respective second actuation signals may be obtained through the connection of resistors.

The operation of the circuitry shown in FIG. 2 is as follows. When the key switch 9 is turned on to close the power circuit, if the engine has not completed its starting, the movable contact 60 of the check signal generator 6 is in contact with the contact 61 at the supply potential, with the result that the base current flows to the transistor 200 through the resistor 202 independently of the output signal of the sensor 1-1 and the collector-emitter section of the transistor 200 conducts thus supplying current through the indicator lamp 3-1 and causing it to go on. When the lamp 3-1 goes on, it is an indication that there is no fault in the circuitry. As soon as the engine starts fully, the movable contact 60 of the check signal generator 6 comes into contact with the contact 62 at the ground potential. In this case, if the contacts of the sensor 11 are in the closed position as shown in FIG. 2, the base potential of the transistor 200 is made equal to the emitter potential through the resistor 202, and the transistor 200 is turned off to switch off the lamp 3-1. When the contacts of the sensor 11 open, that is, when there is a fault in the check point, the divided voltage determined by the resistors 201 and 202 and the diode 203 becomes higher than the value of the threshold voltage between the base and emitter of the transistor 200 and the transistor 200 is turned on to light the lamp 3-1. This indicates that there is a fault in the circuitry. In summary, if the lamp 3-1 goes on when the key switch 9 is closed and the engine is not starting as yet, it is an indication that the lamp 3-1 has not burnt out and the lamp operating transistor 200 is functioning normally, whereas if the lamp 3-1 is not lighted, it is an indication that the lamp 3-1 has burnt out or there is any fault in the circuitry. The driver can know these facts before driving the vehicle. After the engine has started, if the lamp 3-1 goes on, it is an indication that there is a fault at the particular check point involved, whereas if the lamp 3-1 does not go on, it is an indication that there is no fault.

FIG. 3 illustrates another form of the indicator operating circuit 2-1, which is an equivalent circuit designed so that the circuitry of FIG. 2 may be readily realized with semiconductor integrated circuit (IC). While there are instances where a plurality of the same circuits of the type as shown in FIG. 2 are used simultaneously, this is not advisable since the actual assembling of separate components results in a deteriorated reliability due to an increased number of components used, an increased manhour and an increased space required for each component. FIG. 3*a* illustrates an equivalent circuit for an integrated circuit realized in monolithic IC form using a diode transistor logic to overcome the abovementioned difficulty. In FIG. 3*a*, numeral 210 designates a lamp operating transistor corresponding to the transistor 200 of FIG. 2, 211 a driver transistor connected to the transistor 210 in Darlington configuration, 212 through 214 bias resistors for the transistors 210 and 211, 215 a load resistor for the transistor 211. The resistor 213 corresponds to the resistor 202 of FIG. 2. A diode 216 and a Zener diode 213 are level shifting diodes corresponding to the diode 203 of FIG. 2. Numerals 218 and 219 designate input diodes which are not necessarily essential where there is only one input signal, but are useful in case the logical sum or logical product of a plurality of input signals are to be produced. A diode 220 corresponds to the diode 204 of FIG. 2 and it needs not be necessarily provided as shown. FIG. 3*b* shows the circuitry of FIG. 3*a* in logic diagram form, that is, the dashed circuit portion of FIG. 3*a* is represented by a logic symbol for the conventional NAND gate. In FIG. 3*b*, terminals 221, 222, 223 and 224 are the same as those which are shown in FIG. 3*a*, and $+V_{CC}$ and GND terminals are not shown in accordance with the custom. FIG. 3*c* shows an exemplary form of an integrated circuit containing three channels located within a known type of 14-pin dual-in-line package.

FIG. 4 illustrates a wiring diagram showing an exemplary form of the centralized warning section including the centralized warning circuit 4. The section primarily comprises the oscillator 4*c* constituting the pulse generating circuit for operating or flashing the master warning device or lamp 5, the timer circuit 4*b* for controlling the oscillation time of the oscillator 4*c* and the OR circuit 4*a* for actuating the timer circuit 4*b*. It would be obvious to those skilled in the art that the circuit of FIG. 4 which comprises transistors 401 and 402, resistors 404 through 409, capacitors 410 and 411 and diodes 412 and 413, is a known type of free running multivibrator constituting the oscillator 4*c*. In the present invention, for the purpose that will be explained later, this free running multivibrator differs somewhat from the known type of free running multivibrator in that the master warning lamp 5 is connected to the collector of the transistor 402 whose base is in turn connected to the collector of a third controlling transistor 403 and that the potential of the supply line or ground conductor is selectively applied in the polarity shown to the base of the other transistor 401 through a diode 414. In other words, when the key switch 9 is closed to switch on the power from the power source and the engine is not starting as yet, contrary to the operation described in connection with FIG. 2, the movable contact 60' of the check signal generator 6' is grounded as shown in contrast to the case of FIG. 2 and a check signal is generated. Consequently, the potential between the base and emitter of the transistor 401 drops belows the threshold voltage, with the result that the transistor 401 is forcibly turned off and hence the transistor 402 is turned on, causing the master warning lamp 5 to remain on and thereby to give an indication that there is a fault condition. In this case, the transistor 403 is turned off as mentioned earlier and will be explained later. Since, after the engine has started fully, the potential at the movable contact 60' rises to the supply voltage and the diode 414 is rendered nonconductive, the check signal generator 6' is now isolated from the operation of the circuit. Further, if the transistor 403 is conducting, then the potential between the base and emitter of the transistor 402 drops below the threshold voltage, with the result that the transistor 402 is forcibly turned off to terminate the oscillation and the master warning lamp 5 remains off.

The timer circuit 4*b* which controls the opration described above will now be described. In other words, transistors 415 and 403 form, along with a capacitor 423 and resistors 417 and 418, a type of one-shot-multivibrator timer circuit 4*b*. Resistors 419 and 420 constitute a bias circuit for the transistor 415 and a diode 424 is a level shifting diode for the transistor 403. These elements have no direct effect on the essential timing function of the timer circuit 4*b*. Let it be assumed that the movable contact 60' of the check signal generator 6' is in engagement with the contact 61' at the supply potential and no check signal is generated. Let it also be assumed that the base potential of the transistor 415 is zero, i.e., it is below the threshold voltage between the base and emitter of the transistor 415 so that the transistor 415 is turned off. In this case, the charging current flows through the resistor 418 into the capacitor 423 and to the diode 424 and between the base and emitter of the transistor 403 and thus the transistor 403 is turned on. The capacitor 423 is charged in the polarity shown up to about the supply voltage value, after which the base current continues to flow to the transistor 403 through the resistor 417 and the transistor 403 is maintained in the conductive condition. Consequently, the base potential of the transistor 402 in the free running multivibrator is decreased to about the ground potential to turn the transistor 402 off and the lamp 5 remains off. As soon as the base potential of the transistor 415 becomes higher than the threshold voltage between the base and emitter thereof, the transistor 415 is turned on, and the potential at a junction point A of the resistor 417, the capacitor 423 and the diode 424 drops to a negative potential sufficiently lower than the threshold voltage between the base and emitter of the transistor 403 due to the charge previously stored in the capacitor 423. Consequently, the transistor 403 is turned off and the base of the transistor 402 becomes independently of the connection of the transistor 403. When this occurs, as mentioned earlier, the free running multivibrator goes into a free running operation and causes the lamp 5 to flash. However, the charging current flows through the resistor 417 to the capacitor 423 and through the collector and emitter of the transistor 415, so that after the expiration of a predetermined time, the capacitor 423 is charged with a polarity opposite to that shown to a potential equivalent to the threshold voltage between the base and emitter of the transistor 403 plus the forward voltage value of the diode 424. Consequently, the transistor 403 is again turned on to stop the oscillation and the lamp 5 is turned off to terminate the centralized warning.

Next, the OR circuit 4*a* will be described. An inverter is formed with a transistor 416, a collector resistor 421 and level shifting diodes 425, and a NAND gate is formed with a resistor 422 and diodes 204 and 204'. These inverter and NAND gate form a negative logic OR circuit. The collector of the transistor 416 is connected to the base of the transistor 415 through the bias resistor 419, and the base of the transistor 416 is connected through the level shifting diodes 425 to the output diodes 204 and 204' which deliver the second actuation signals from the indicator operating circuits 2-1 and 2-2 shown in FIG. 2. Consequently, when the outputs of the plurality of indicator operating circuits 2-1 and 2-2 are all of the high level, that is, when there is an indication that all of the check points are in good condition, the logical output of the OR circuit 4*a* or the output of the inverter goes to the low level and thus the lamp 5 remains off as described earlier. On the other hand, when the output of any one of the indicator operating circuits goes to the low level, the logical output of the OR circuit 4*a* or the output of the inverter goes to the high level and the lamp 5 starts flashing to give centralized warning. When this flashing operation continues for a predetermined time determined by the resistor 417, the capacitor 423 and the supply voltage value, the lamp 5 ceases flashing and remains off due to the action of the timer circuit 4*b* even when the output of that particular indicator operating circuit remains at the low level.

FIG. 5 illustrates a wiring diagram showing another form of the centralized warning section which is identical in construction with the arrangement of FIG. 4 except that the respective output diodes 204'' and 204''' of the indicator operating circuits 2-3 and 2-4 which are different from the indicator operating circuits 2-1 and 2-2 shown in FIG. 4, are connected to the point A. Consequently, as will be readily understood from the description of the operation made in connection with FIG. 4, the indicator operating circuits added in the arrangement of FIG. 5 affect the transistor 403 prior to the output of the timer circuit 4*b*, and the application of the outputs from the diodes 204'' and 204''' renders the transistor 403 nonconductive to sustain oscillation.

Further modifications are possible, although they are not shown in the drawings. For example, with the arrangement shown in FIG. 5, it may be useful to eliminate the timer circuit 4*b* and connect all of the inputs to the point A.

FIG. 6 illustrates an exemplary form of the checking section which provide means for checking the function of the indicator operating circuits 2-1, 2-2, . . . , 2-n, the centralized warning circuit 4, the indicators 3-1, 3-2, . . . , 3-n and the master warning device 5 before driving a vehicle. Namely, there is illustrated a specific form of a circuit for realizing the check signal generator 6 or switching means shown in FIGS. 2 and 4. In FIG. 6, the three-phase AC generator 7 driven from the engine and constituting stopping means has three generating coils 70, 71 and 72 which are Y-connected and whose outputs are subjected to three-phase full-wave rectification by a group of rectifying diodes 73. Numeral 74 designates a field coil for generating a DC field whose field current is controlled by a voltage regulator 80 to provide a constant output voltage. The voltage regulator 80 comprises a movable contact 840 actuated by an energizing coil 800 and a movable contact 850 actuated by an energizing coil 810. A stationary contact 860 on the coil 810 side is connected to the output terminal of the generator 7 and the other stationary contact 870 is grounded. The coil 810 is connected to a neutral point N of the Y-connected generating coils 70, 71 and 72, and a DC voltage of about one half of the output voltage is generated at the neutral point N when the number of revolutions of the generator 7 becomes higher than the idling speed. The coil 800 is connected to the movable contact 850 so that while the coil 800 is grounded through the contact 870 when the engine is at rest, as soon as the generator 7 starts operating due to the rotation of the engine, the voltage at its output terminal is applied to the coil 800 through the contact 860 by the energization of the coil 810. Consequently, the movable contact 840 is transferred between two stationary contacts depending upon the magnitude of the output voltage applied to the coil 800 to insert and remove a current regulating resistor 830 of the field coil 74 to maintain the output voltage at a predetermined voltage. On the other hand, with the engine at rest, a charge warning lamp 10 goes on as it is grounded through the contacts 850 and 870, whereas when the generator starts operating the lamp 10 goes off since it has the same potential at each end thereof.

Since the diode 414 in the centralized warning circuit 4 is connected as shown in FIG. 6 to the movable contact 850 in order that the fault finding check on the master warning device 5 and the centralized warning circuit 4 may be completed before the engine starts, as will be apparent from the previous description, the cathode side of the diode 414 is grounded when the engine is at rest, whereas it is raised to the supply voltage as soon as the entine starts operating. Further, to check the indicator operating circuits 2-1, and 2-2, it is only necessary to operate the contacts 60, 61 and 62 through an energizing coil 63. In other words, one end of the energizing coil 63 is connected to the power supply side and the other end is connected to the movable contact 850 through a diode 64 provided as shown in FIG. 6. When the energizing coil 63 is not energized, the movable contact 60 is in engagement with the contact 62 as shown in FIG. 6. Prior to the starting of the engine, the movable contact 60 engages the contact 61 so that current flows from the power source to the resistors 202 and 202' of the indicator operating circuits 2-1 and 2-2, whereas when the energizing coil 63 is deenergized after the engine has started, the resistors 202 and 202' are grounded to terminate the fault finding check. Further, the diode 64 is provided to prevent the occurrence of any operating difficulty such as one in which when the engine key switch 9 is opened with the engine operating, an ignition coil 11, for example, may be continuously energized from the power source through the contacts 860 and 850 and through the coil 63 so that the opening of the key switch 9 cannot stop the engine.

While, in the embodiment described above, the check signal generator 6 is shown as one in which the contacts are opened and closed, it may for example be a contactless transistor circuit. Further, while the stopping means comprises the three-phase AC generator 7, it may be replaced with a timer circuit which generates a timing output upon closing of the power circuit by the key switch 9, a running detector which detects the running of a vehicle to stop the generation of the checking signal or a circuit which makes uses of an oil pressure meter for detecting the engine oil pressure as illustrated in FIG. 8.

FIG. 7 illustrates another form of the centralized warning section in which a triggering timer circuit constituted by utilizing part of the one-shot timer circuit 4b and the OR circuit 4a shown in FIGS. 4 and 5, is connected to each of the output diodes 204, 204', 204'' and 204''' of the plurality of indicator operating circuits 2-1, 2-2, 2-3 and 2-4, whereby the logical sum of the outputs from a plurality of triggering timer circuits 400, 400', etc. is produced by an OR circuit 4d and it is then coupled to the oscillator 4c to control the operation and on-operation of the oscillator 4c. In FIG. 7, numerals 417, 426, 431 and 432 designate resistors 428 and 430 transistors, 429 and 433 diodes. With the construction described above, the following effect is obtained. In other words, after the master warning device 5 has been in operation for a predetermined time in response to the detection of a fault by the first sensor, the master warning device 5 is brought into operation for the predetermined time each time the second and third sensors respectively detect a fault. In this way, when faults occur sequentially at various check points, the driver may be warned against them each time a further fault is detected. Accordingly, in the arrangement of FIG. 7, the one-shot triggering timer circuit 400 is realized by adding the transistor 428 and the resistor 426 to the arrangement of FIG. 4, and the OR circuit 4d comprising a transistor 430 is additionally provided at the preceding stage of the transistor 403 which controls the oscillator 4c to start and stop oscillation. Numeral 429' designates a diode which functions similary as the diode 429 whereby the logical sum of the outputs of the first and second triggering timer circuits 400 and 400' is produced and applied to the base of the transistor 430. As will be readily understood from the descriptions of the operations made in connection with FIGS. 4 and 5, when all of the outputs from the triggering timer circuits 400, 400', etc. are at the low level, the transistor 430 is turned off and the transistor 403 is turned on to stop the oscillation in the oscillator 4c, whereas only during the time when the output of any one of the plurality of triggering timer circuits 400, 400', etc. is at the high level, that is, during a predetermined time following the detection of a fault by one of the sensors, the transistor 430 is turned on and the transistor 403 is turned off to cause the master warning devie 5 to flash.

What we claim is:

1. A centralized warning system for a vehicle comprising:

(1) a plurality of sensors each for detecting a vehicle operating fault at one of a plurality of check points of said vehicle and generating a corresponding electric output signal;

(2) a plurality of indicators provided respectively corresponding to each of said plurality of sensors;

(3) a plurality of indicator operating circuits connected to the respective indicators and sensors, each of said operating circuits generating, in accordance with the output signal of each sensor, an output signal for causing a corresponding one of said indicators to indicate the presence of a fault in the corresponding check point;

(4) a logical circuit connected to each of said operating circuits for generating a logical output in response to the output signal from that indicator operating circuit;

(5) a timer circuit connected to said logical circuit for generating a timing signal of a fixed time duration upon receipt of said logical output of said logical circuit; and (6) a master warning device operatively connected to said timer circuit for producing a warning signal in response to said timing signal and for automatically ceasing production of said warning signal at the end of said fixed time duration even when a sensor continues to produce said output signal after said fixed time duration.

2. A system according to claim 1, wherein said logical circuit consists of an OR circuit for producing the logical sum of output signals of said plurality of indicator operating circuits.

3. A centralized warning system according to claim 1, further comprising:

(1) at least one further sensor for detecting a condition at a vehicle check point and generating a corresponding electrical output signal, a further indicator corresponding to said further sensor and a further indicator operating circuit connected to said further sensor and said further indicator for generating in accordance with the output signals of said further sensor, an output signal for causing said further indicator to indicate the presence of a fault at a check point; and (2) a further logical circuit connected to said further indicator operating circuit and connected to the junction of said timer circuit and said master warning device for causing said master warning device to produce said warning signal.

4. A system according to claim 2, wherein said logical circuits consists of OR circuits.

5. A system according to claim 2, further comprising a check device for selectively operating said plurality of indicators, said further indicator and said master warning device independently of the presence or absence of the output signals of said plurality of sensors.

6. A system according to claim 5, wherein said check device has an input terminal connected to an engine-driven generator of the vehicle for producing a check output when the voltage generated by said generator does not reach a predetermined value.

7. A system according to claim 1, wherein said timer circuit comprises:

a transistor circuit connected to said logical circuit to operate in response to the logical output; and a charge and discharge circuit comprising a resistor and capacitor connected to said transistor circuit, said capacitor charging and discharging in response to the operation of said transistor circuit for generating a terminal voltage as said timing signal.

8. A centralized warning system according to claim 1, further comprising a pulse generating circuit connecting said timer circuit and said master warning device for generating in response to said timing signal a pulse train signal to intermittently operate said master warning device.

9. A system according to claim 1, further comprising a check device for selectively operating said plurality of indicators and said master warning device independently of the presence or absence of the output signals of said plurality of sensors.

10. A system according to claim 9, wherein said check device includes a timer circuit therein and is connected to an electrical power supply switch of the vehicle whereby a check signal output is produced for a predetermined time period after the closure of said power switch.

11. A system according to claim 9, wherein said check device has an input terminal connected to an engine-driven generator of the vehicle for producing a check output when a voltage generated by said generator does not reach a predetermined value.

12. A system according to claim 9, wherein said check device is connected to an engine starter switch whereby it produces a check signal during starting operation of the engine.

13. A system according to claim 9, wherein said check device is connected to an engine oil pressure detector switch whereby it produces a check output when the engine oil pressure does not reach a predetermined value.

14. A system according to claim 9, wherein each of said sensors consists of a normally closed sensor.

15. A centralized warning system for a vehicle comprising:

(1) a plurality of sensors each for detecting a vehicle operating fault at each of a plurality of check points of said vehicle and generating a corresponding electric output signal;

(2) a plurality of indicator means connected respectively to said sensors for indicating the generation of the corresponding electric output signal indicating the presence of a fault at the respective check points;

(3) a master warning device for generating a warning signal in response to the indicating operation of said plurality of indicator means; and (4) control means connected to said plurality of indicator means and said master warning device, including means for generating a timer signal responsive to the indicating operation of at least one of said plurality of indicator means, for connecting the timer signal to said master warning device and limiting the generation of the warning signal to a predetermined period of time determined according to said claim timer signal without changing the indicating operation of said plurality of indicator means, even when an indicator means continues an indicating operation after said predetermined period.

16. A system according to claim 15, wherein said control means includes an OR circuit for producing a logic sum of indicating output signals of said plurality of indicator means.

17. A system according to claim 15, wherein said control means includes a pulse generating circuit connected to said master warning device for generating in response to said timer signal a pulse train signal to intermittently operate said master warning device.

18. A system according to claim 15, further comprising a check device for selectively operating said plurality of indicator means and said master warning device independently of the presence or absence of the output signals of said plurality of sensors.

19. A system according to claim 18, wherein said check device includes a check signal generator for generating a check signal during a period of time from the initiation of engine starting operation of the vehicle to the termination thereof.

20. A system according to claim 19, wherein said vehicle includes a three-phase AC generator having a neutral point terminal, and said check signal generator includes relay means responsive to voltage at said neutral point for generating the check signal until a predetermined level of voltage is developed at said neutral point.

21. A system according to claim 18, wherein said vehicle includes a power switch for starting feeding of electric power and a three-phase AC generator having a neutral point terminal, and said check device includes a check signal generator for generating a check signal in a period of time from closure of said power switch until a predetermined level of voltage is developed at said neutral point terminal.

22. A system according to claim 15, wherein said control means includes a logical circuit connected to each of said indicator means for generating a logical output in response to the output signal from at least one of said plurality of indicator means, and said timer signal generating means comprises a timer circuit connected to said logical circuit for generating the timer signal of a fixed time duration upon receipt of said logical output.

23. A system according to claim 22, wherein said timer circuit comprises:

a transistor circuit connected to said logical circuit to operate in response to the logical output; and a charge and discharge circuit comprising a resistor and capacitor connected to said transistor circuit, said capacitor charging and discharging in response to the operation of said transistor circuit for generating a terminal voltage as said timing signal.

24. A system according to claim 15, wherein said control means includes a logical circuit connected to each of said indicator means for generating a logical output in response to the output signal from at least one of said plurality of indicator means, and said timer signal generating means comprises a timer circuit connected to said logical circuit for generating the timer signal of a fixed time duration upon receipt of said logical output, and a pulse generating circuit connected to said timer circuit and said master warning device for generating in response to said timer signal a pulse train signal to intermittently operate said master warning device.

25. A system according to claim 24, wherein said timer circuit comprises:

a transistor circuit connected to said logical circuit to operate in response to the logical output; and a charge and discharge circuit comprising a resistor and capacitor connected to said transistor circuit, said capacitor charging and discharging in response to the operation of said transistor circuit for generating a terminal voltage as said timing signal.

26. A centralized warning system for a vehicle comprising:

(1) a plurality of sensors each for detecting a vehicle operating fault at each of a plurality of check points of said vehicle and generating a corresponding electric output signal;

(2) a plurality of indicator means connected respectively to said sensors for indicating the generation of the corresponding electric output signal indicating the presence of a fault at the respective check points;

(3) control means connected to each of said plurality of indicator means for generating a timer signal of a fixed time duration in response to the output signal generated from at least one of said plurality of indicator means and without affecting the indicating operation of said indicator means; and (4) a master warning device connected to said control means for producing a warning signal in response to said timer signal and for automatically ceasing production of said warning signal at the end of said fixed time duration, even if a sensor continues to produce an output signal after said fixed duration.

27. A centralized warning system as in claim 26, wherein said control means comprises:

a plurality of said timer circuits each connected to the respective indicator means for producing said timer signal of a fixed duration upon receipt of the output signal of the respective indicator means; and a logic circuit connecting said plurality of timer circuits to said master warning circuit for producing said logical signal output in response to said timer signal of at least one of said timer circuits.

28. A centralized warning system according to claim 27, further comprising a pulse generator circuit connecting said logic circuit and said master warning device for generating in response to said logical signal output a pulse signal to intermittently operate said master warning device.

29. A system according to claim 27, wherein said logic circuit consists of an OR circuit for producing a logical sum of timing signals of said plurality of timer circuits.

30. A system according to claim 27, further comprising a check device for selectively operating said plurality of indicator means and said master warning device independently of the presence or absence of the output signals of said plurality of sensors.

31. A centralized warning system for a vehicle comprising:

(1) a plurality of sensors each for detecting a vehicle operating fault at one of a plurality of check points of said vehicle and generating a corresponding electric output signal;

(2) a plurality of indicators provided respectively corresponding to each of said plurality of sensors;

(3) a plurality of indicator operating circuits connected to the respective indicators and sensors, each of said operating circuits generating, in accordance with the output signal of each sensor, an output signal for causing a corresponding one of said indicators to indicate the presence of a fault in the corresponding check point;

(4) means including a logical circuit and a timer circuit for generating a timing signal of a fixed time duaration in response to the output signal generated by at least one of said plurality of indicator operating circuits; and (5) a master warning device operatively connected to said timer circuit for producing a warning signal in response to said timing signal and for automatically ceasing production of said warning signal at the end of said fixed time duration, even if a sensor continues to produce an output signal after said fixed duration.

* * * * *